US008250836B2

(12) United States Patent
Choi et al.

(10) Patent No.: US 8,250,836 B2
(45) Date of Patent: Aug. 28, 2012

(54) APPARATUS AND METHOD FOR AUTOMATICALLY LOADING DRUMS INTO DRUM CONTAINER

(75) Inventors: Jong-Rak Choi, Daejeon (KR); Sung-Hwan Chung, Daejeon (KR); Sung-Jin Kim, Busan (KR)

(73) Assignees: Korea Hydro & Nuclear Power Co., Ltd., Seoul (KR); Bukwang Industrial Co., Ltd., Busan (KR)

( * ) Notice: Subject to any disclaimer, the term of this patent is extended or adjusted under 35 U.S.C. 154(b) by 274 days.

(21) Appl. No.: 12/816,474

(22) Filed: Jun. 16, 2010

(65) Prior Publication Data

US 2011/0196530 A1 Aug. 11, 2011

(30) Foreign Application Priority Data

Feb. 5, 2010 (KR) ..... 10-2010-0011156

(51) Int. Cl.

| | |
|---|---|
| ***B65B 5/08*** | (2006.01) |
| ***B65B 7/28*** | (2006.01) |
| ***B65B 35/58*** | (2006.01) |
| ***G21F 5/14*** | (2006.01) |

(52) U.S. Cl. ..... 53/446; 53/467; 53/475; 53/544; 53/244; 53/284.5; 414/799; 588/16

(58) Field of Classification Search ..... 53/446, 53/467, 471, 475, 543, 544, 244, 281, 284.5; 414/799; 588/16; *G21F 5/14*

See application file for complete search history.

(56) References Cited

U.S. PATENT DOCUMENTS

| | | | | |
|---|---|---|---|---|
| 3,284,985 | A * | 11/1966 | Roth | 53/543 |
| 3,402,831 | A * | 9/1968 | Coombe | 414/799 |
| 3,740,919 | A * | 6/1973 | Heisler | 53/446 |
| 3,848,394 | A * | 11/1974 | Heisler | 53/446 |
| 4,151,983 | A * | 5/1979 | Stock et al. | 294/66.2 |
| 4,475,860 | A * | 10/1984 | Okamoto et al. | 414/416.03 |
| 4,686,813 | A * | 8/1987 | Sawada | 53/446 |
| 5,415,520 | A * | 5/1995 | Seiver | 414/799 |
| 6,074,155 | A * | 6/2000 | Hirschek | 414/273 |
| 7,621,713 | B2 * | 11/2009 | Pen et al. | 414/799 |
| 2009/0159550 | A1 * | 6/2009 | Singh et al. | 588/16 |
| 2010/0270482 | A1 * | 10/2010 | Werschnik et al. | 250/507.1 |

FOREIGN PATENT DOCUMENTS

| | | | |
|---|---|---|---|
| DE | 3420747 | A1 * | 12/1985 |
| EP | 1491465 | A1 * | 12/2004 |
| JP | 53084855 | A * | 7/1978 |
| JP | 2001183498 | A * | 7/2001 |
| JP | 2003156594 | A * | 5/2003 |
| JP | 2004170280 | A * | 6/2004 |
| JP | 2008175796 | A * | 7/2008 |

* cited by examiner

*Primary Examiner* — Stephen F Gerrity
(74) *Attorney, Agent, or Firm* — Leydig, Voit & Mayer, Ltd.

(57) ABSTRACT

An apparatus and method for automatically loading drums into a drum container, in which, when the drums filled with radioactive waste are loaded into the drum container, the drums are fed to a designated position, and placed at a fixed position, reducing loading time and manpower as well as minimizing radiation exposure risk associated with radioactive waste treatment. The apparatus includes a drum feeder having conveyor modules transferring the drums and a turntable rotating a drum transferred to an orientation where the drum can be gripped, for sequentially loading the drums, a support frame on which a lid of the drum container is placed when the drums are being loaded, and a crane that grips and transfers the drum or the drum container lid.

13 Claims, 5 Drawing Sheets

APPARATUS AND METHOD FOR AUTOMATICALLY LOADING DRUMS INTO DRUM CONTAINER

FIELD OF THE INVENTION

1. Technical Field

The present invention disclosed herein relates generally to an apparatus and method for remotely, automatically loading drums filled with radioactive waste into a drum container, and more particularly to an apparatus and method for automatically loading drums into a drum container, in which when the drums filled with the radioactive waste are loaded into the drum container, the drums are fed to a designated position, and always placed at a fixed position, thereby reducing a loading time of the drums and necessary manpower as well as minimizing a radiation exposure risk associated with radioactive waste treatment.

2. Related Art

In general, radioactive waste is inevitably generated from systems or facilities using atomic energy such as atomic power stations.

This radioactive waste must be carefully treated due to radiation of radioactive rays that are harmful to the human body. As such, it is important to treat the radioactive waste within as short a time as possible, and workers must handle the radioactive waste from as far away as possible so as not to be directly exposed to the radioactive waste.

Conventionally, in order to load the drum filled with the radioactive waste into the drum container, the drum container is placed at a given place, and then a lid of the drum container is opened using a lid handling unit or a crane hook. The drums placed at another given place are loaded into the drum container using a drum gripper, and then the drum container lid is gripped and covered on the drum container.

In this case, an operator of the drum loading apparatus must check a position of the drum using a monitoring camera or with his or her eye, and manipulate the drum gripper to grip the drum. Therefore the drum gripper may collide with the drum or it may be difficult to correctly grip the drum.

Even after the drum is gripped by the drum gripper, the operator must operate the drum gripper while watching an upper portion and sides of the drum container in order to avoid collision with the drum loaded in the drum container in the process of loading the drum to a designated position of the drum container, and thus it takes much time to load the drum.

In addition, in the process of covering the drum container lid on a body of the drum container again after the drums are loaded, the operator approaches the drum container in which the radioactive waste drums are contained, checks whether or not holes of bolts for coupling the drum container are matched with his or her eye, and adjusts a position of the drum container lid so as to be fitted to the bolt holes. Therefore, much manpower and working time are required, resulting in a radiation exposure risk.

SUMMARY

The present invention is directed to an apparatus and method for automatically loading drums into a drum container, in which when the drum filled with radioactive waste is loaded into the drum container, the drum is fed to a designated position so as to be easily gripped by a gripper, and always located at a fixed place, thereby enabling automation of a drum loading process.

According to an aspect of the present invention, there is provided an apparatus for automatically loading drums into a drum container, which includes: a drum feeder having: a plurality of conveyor modules transferring the drums filled with radioactive waste; and a turntable rotating the drum transferred by the conveyor modules in a direction where the drum can be gripped by a gripper; a drum container into which the drums transferred through the drum feeder are sequentially loaded; a support frame on which a lid of the drum container is placed when the drums are loaded; and a crane having: the gripper that grips and transfers the drum or the drum container lid; and a lifter on which the gripper is mounted so as to move up and down and which is transferred along guide rails in forward and backward, or left and right directions.

In exemplary embodiments, the drum feeder may further include: sensors sensing a position of a drum bolt fastened on an outer circumference of the drum; and a controller controlling a rotational amount of the turntable on a basis of position signals of the drum bolt sensed by the sensors.

In exemplary embodiments, each conveyor module may include an interlocking unit that restricts movement of the downstream conveyor module when the drum is located on the upstream conveyor module.

In exemplary embodiments, the gripper may include: a plurality of gripper arms radially installed at regular angular intervals; an arm hydraulic unit reciprocating the gripper arms in a radial direction; jaws installed on inner sides of the gripper arms and gripping an outer surface of the drum by operation of the arm hydraulic unit; and latches protruding from the inner sides of the gripper arms and latched on the drum container lid.

In exemplary embodiments, the lifter may include a plurality of cylinders and rods for transferring the gripper in upward and downward directions so as to prevent the gripper gripping the drum or the drum container lid from swinging.

According to another aspect of the present invention, there is provided an apparatus for automatically loading drums into a drum container, which include: a drum feeder transferring the drums filled with radioactive waste; a drum container into which the drums transferred through the drum feeder are sequentially loaded; a support frame on which a lid of the drum container is placed when the drums are loaded; a crane having: the gripper that grips and transfers the drum or the drum container lid; and a lifter on which the gripper is mounted so as to move up and down and which is transferred along guide rails in forward and backward, or left and right directions; and a drum container clamp having: drum container pedestals on which corners of the bottom of the drum container are supported; and a pusher that pushes the drum container supported on the drum container pedestals on one side of the drum container and fixes the drum container in close contact with the drum container pedestals on the other side of the drum container.

In exemplary embodiments, each drum container pedestal may include: a base plate; and a bracket whose shape corresponds to a shape of each corner of the bottom of the drum container and which protrudes upward from the base plate.

In exemplary embodiments, the brackets may be disposed at a slightly longer distance than a length of the drum container in a direction where the drum container is pushed by the pusher, and at a distance corresponding to a width of the drum container in a direction perpendicular to the direction where the drum container is pushed by the pusher.

In exemplary embodiments, the pusher may include a hydraulic cylinder and an oil supply.

In exemplary embodiments, the gripper may include: a plurality of gripper arms radially installed at regular angular intervals; an arm hydraulic unit reciprocating the gripper arms in a radial direction; jaws installed on inner sides of the gripper arms and gripping an outer surface of the drum by operation of the arm hydraulic unit; and latches protruding from the inner sides of the gripper arms and latched on the drum container lid.

In exemplary embodiments, the lifter may include a plurality of cylinders and rods for transferring the gripper in upward and downward directions so as to prevent the gripper gripping the drum or the drum container lid from swinging.

According to yet another aspect of the present invention, there is provided a method of automatically loading drums into a drum container, which includes: placing the drum container on pedestals for the drum container into which the drums filled with radioactive waste are loaded; pushing one side of the drum container placed on the drum container pedestals on one side of the drum container using a pusher and fixing the drum container in close contact with the drum container pedestals located on the other side of the drum container; separating a lid of the drum container from a body of the drum container using a gripper; transferring the drums to a turntable using a plurality of conveyor modules; rotating the turntable to position the drum placed on the turntable so as to be directed to a direction where the drum can be gripped by the gripper; sequentially loading the drums into the drum container using the gripper; and placing the drum container lid on the drum container body using the gripper when the loading of the drums is completed.

In exemplary embodiments, rotating the turntable to position the drum placed on the turntable so as to be directed to a direction where the drum can be gripped by the gripper may include: sensing, by sensors, a position of a drum bolt fastened on an outer circumference of the drum; and controlling a rotational amount of the turntable on a basis of position signals of the drum bolt sensed by the sensors.

A further understanding of the nature and advantages of the present invention herein may be realized by reference to the remaining portions of the specification and the attached drawings.

BRIEF DESCRIPTION OF THE FIGURES

Non-limiting and non-exhaustive embodiments of the present invention will be described with reference to the following figures, wherein like reference numerals refer to like parts throughout the various figures unless otherwise specified. In the figures.

DETAILED DESCRIPTION OF EXEMPLARY EMBODIMENT

Figure 1A:
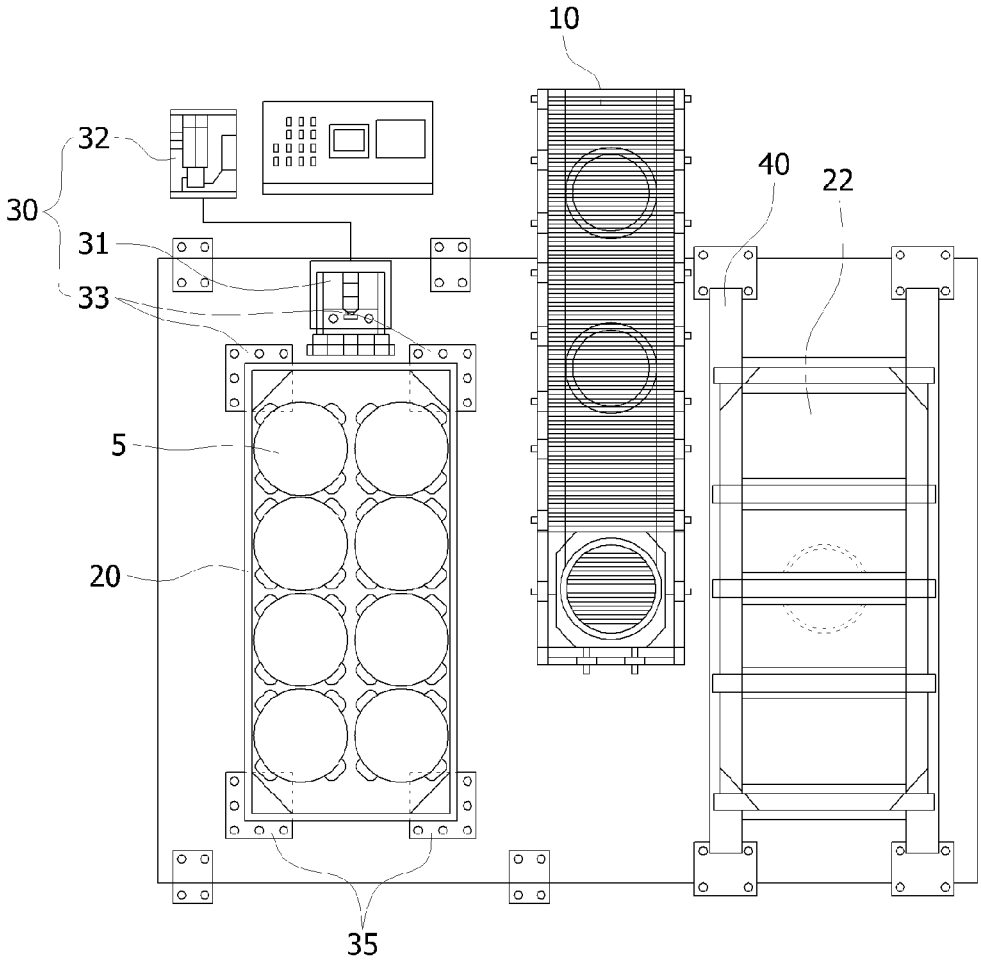
FIGS. 1A and 1B are a plan view and a front view of an apparatus for loading drums into a drum container according to an exemplary embodiment of the present invention.

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art Like reference numerals refer to like elements throughout the accompanying figures.

Figure 1B:
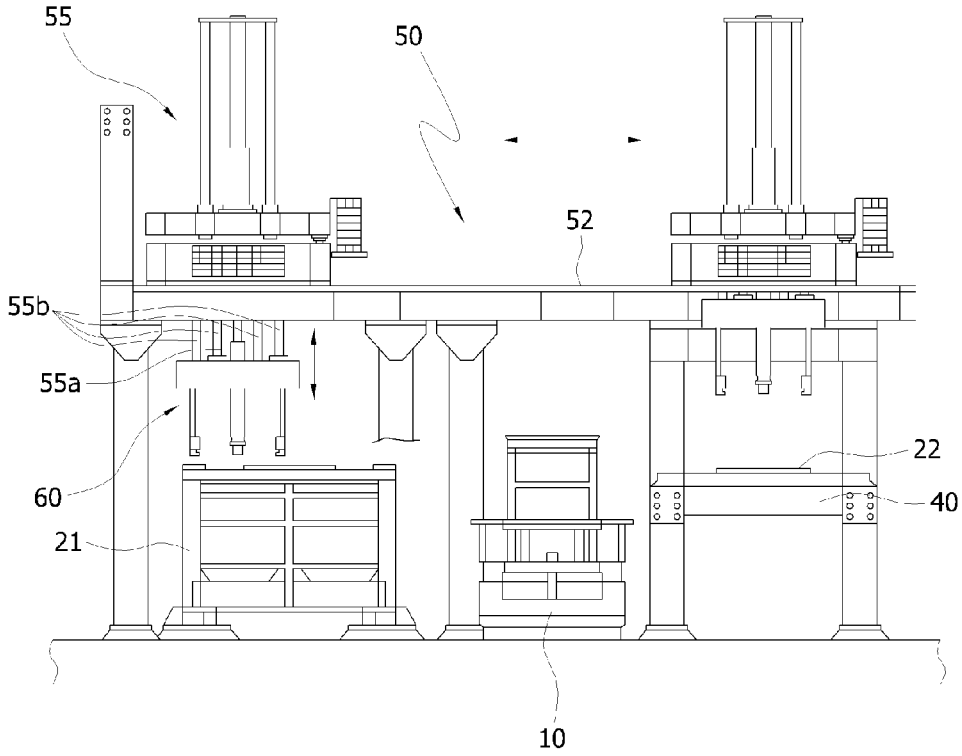

FIGS. 1A and 1B are a plan view and a front view of an apparatus for automatically loading drums into a drum container according to an exemplary embodiment of the present invention.

An apparatus for automatically loading drums and a drum container according to an exemplary embodiment of the present invention includes a drum feeder 10 transferring a drum 5 filled with radioactive waste toward a crane 50, a drum container 20 having a body 21 and a lid 22 into which a plurality of drums 5 are loaded, a drum container clamp 30 fixing the drum container 20 within the drum loading apparatus, and a support frame 40 on which the drum container lid 22 separated from the drum container body 21 is placed when the drums 5 are loaded.

The crane 50 is equipped with a lifter 55 moving along guide rails 52 in forward and backward, or left and right directions, and a gripper 60 selectively gripping the drum 5 or the drum container lid 22 at a lower end of the lifter 55 and moving in cooperation with the lifter 55.

The lifter 55 is provided with a plurality of cylinders 55*a* and rods 55*b*, and is coupled to an upper portion of the gripper 60. Thus, when the drum 5 is loaded, the gripper 60 gripping the drum 5 is prevented from swinging when moving in forward and backward, or left and right directions, so that it can load the drum 5 at an exact position in the drum container 20.

Figure 2A:
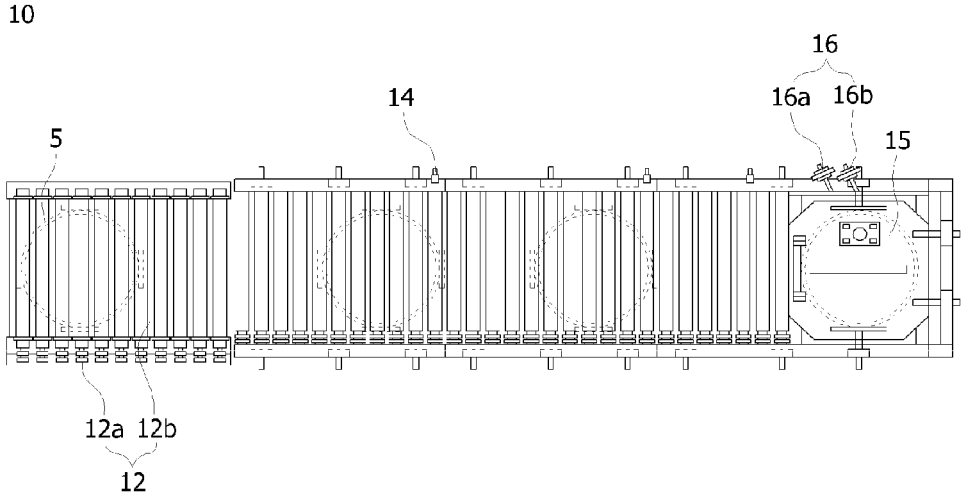
FIGS. 2A through 2C illustrate construction of a drum feeder in an apparatus for automatically loading drums into a drum container according to an exemplary embodiment of the present invention.
Figure 2B:
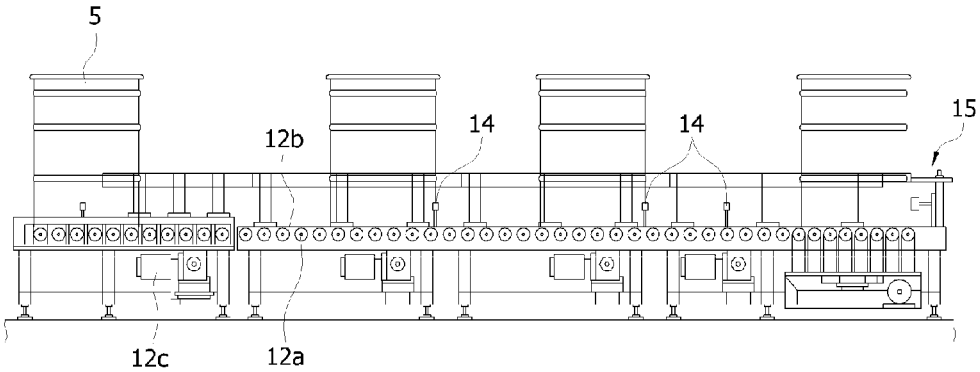
Figure 2C:
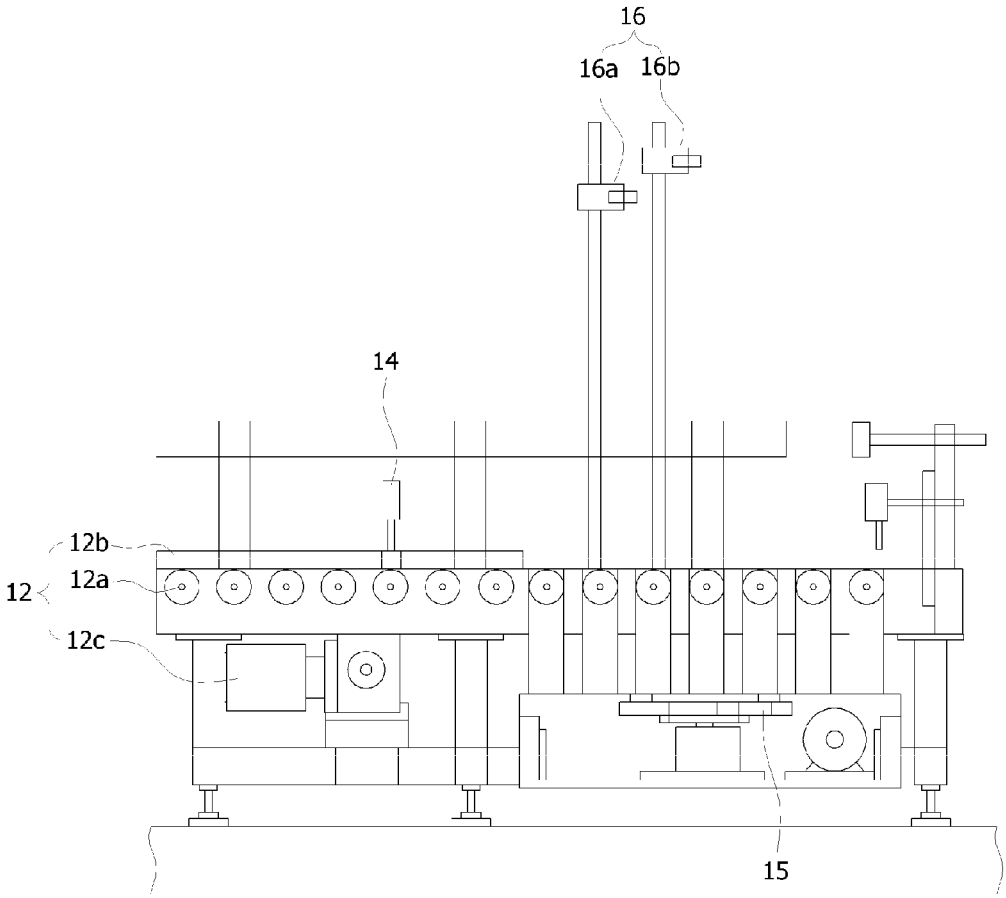

FIGS. 2A through 2C illustrate construction of a drum feeder in an apparatus for automatically loading drums into a drum container according to an exemplary embodiment of the present invention, in which FIG. 2A is a plan view, FIG. 2B is a front view, and FIG. 2C is a front view illustrating the state where no drum is located on a turntable.

The drum feeder 10 includes a plurality of conveyor modules 12 sequentially transferring the drums 5, and a turntable 15 rotating the drum 5 transferred by the conveyor modules 12 in a direction where the drum 5 can be gripped by the gripper 60.

Each conveyor module 12 may include a plurality of rollers 12*a*, a belt 12*b* moving along the rollers, and a conveyor driving motor 12*c* rotating the rollers.

The turntable 15 is installed adjacent to the rear of the most downstream conveyor module of the conveyor modules 12.

Each conveyor module 12 is provided with sensors 14 on opposite long sides thereof which sense the position of the drum 5. The turntable 15 is provided with sensors 16 (16*a* and 16*b*) which sense the position of a drum bolt 5*a* fastened on an outer circumference of an upper end of the drum 5 (see FIGS. 2C and 4).

Further, the drum feeder 10 includes a controller (not shown), which controls an operation of each conveyor module 12 and a rotational amount of the turntable 15 on the basis of the signals sensed by the sensors 14 and 16.

The sensors 14, which are installed on the opposite long sides of the conveyor module 12, sense the position of the drum 5 within each conveyor module 12, and send signals obtained by sensing the position of the drum 5 to the controller. When the drum 5 is located on the upstream conveyor module, the controller drives an interlocking unit (not shown) so as to restrict the operation of the downstream conveyor module.

In this way, the drum feeder 10 controls the operation of the conveyor modules 12 using the sensors 14, the controller, and the interlocking unit, so that it is possible to previously prevent the drums 5 from being damaged by collision between the drums 5 located upstream and downstream of the conveyor modules in the process of feeding the drums 5.

The sensors 16*a* and 16*b* installed on the turntable 15 sense the position of the drum bolt 5*a* fastened on the outer circumference of the drum 5 placed on the turntable 15, and send signals obtained by sensing the position of the drum bolt 5*a* to the controller. The controller controls the rotational amount of the turntable 15 such that a position where the gripper 60 grips the drum 5 in close contact with the outer surface of the drum 5 is located at a portion where the drum bolt 5*a* is not fastened.

Here, as illustrated in FIG. 2C, the sensors 16*a* and 16*b* may be configured to be located at different heights considering that the drums 5 have different heights depending on their capacities (e.g. 200 liters, 320 liters).

Figure 3A:
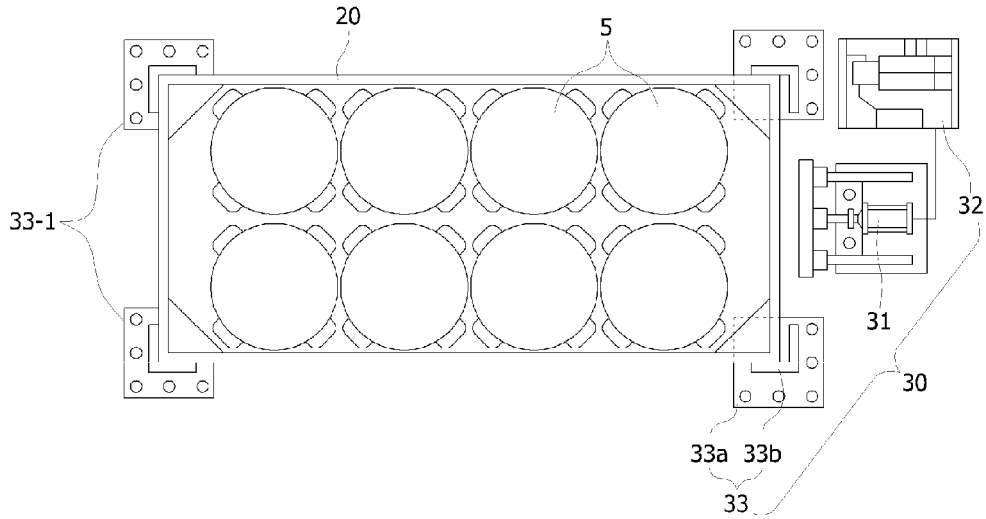
FIGS. 3A and 3B illustrate construction of a drum container clamp in an apparatus for automatically loading drums into a drum container according to an exemplary embodiment of the present invention.
Figure 3B:
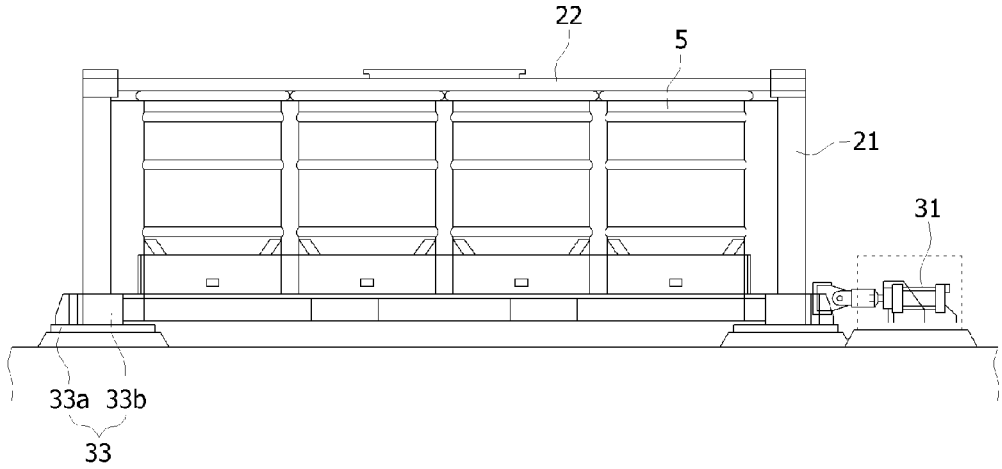

FIGS. 3A and 3B illustrate construction of a drum container clamp in an apparatus for automatically loading drums into a drum container according to an exemplary embodiment of the present invention, in which FIG. 3A is a plan view, and FIG. 3B is a front view.

The drum container clamp 30 includes drum container pedestals 33 on which corners of the bottom of the drum container 20 are supported, and a pusher that pushes the drum container 20 supported on the drum container pedestals 33 on one side of the drum container 20 and thus fixes the drum container 20 in close contact with the drum container pedestals 33-1 on the other side of the drum container 20.

In this embodiment, the drum container 20 has the shape of a hollow cuboid, and includes a body 21 in which the drums 5 are loaded and a lid 22 covering the top of the body 21.

For the structure of the drum container 20 having this cuboidal shape, each drum container pedestal 33 includes a base plate 33*a* fixedly installed on the floor of a building and supporting each corner of the bottom of the drum container 20, and an L-shaped bracket 33*b* protruding upward from the base plate 33*a*.

As illustrated in FIG. 3A, the brackets 33*b* are disposed at a slightly longer distance than a length of the drum container 20 in a direction where the drum container 20 is pushed by the pusher, and at a distance corresponding to a width of the drum container 20 in a direction perpendicular to the direction where the drum container 20 is pushed by the pusher.

The pusher may be made up of a hydraulic cylinder 31 and an oil supply 32. Thus, when the drum container 20 is placed inside the brackets 33*b* of the drum container pedestals 33, the hydraulic cylinder 31 is driven by an oil pressure supplied from the oil supply 32, and thus presses and pushes one side of the drum container 20. Thereby, the other side of the drum container 20 is closely fixed to inner surfaces of the brackets 33*b* of the drum container pedestals 33-1 located on the other side of the drum container 20.

Figure 4:
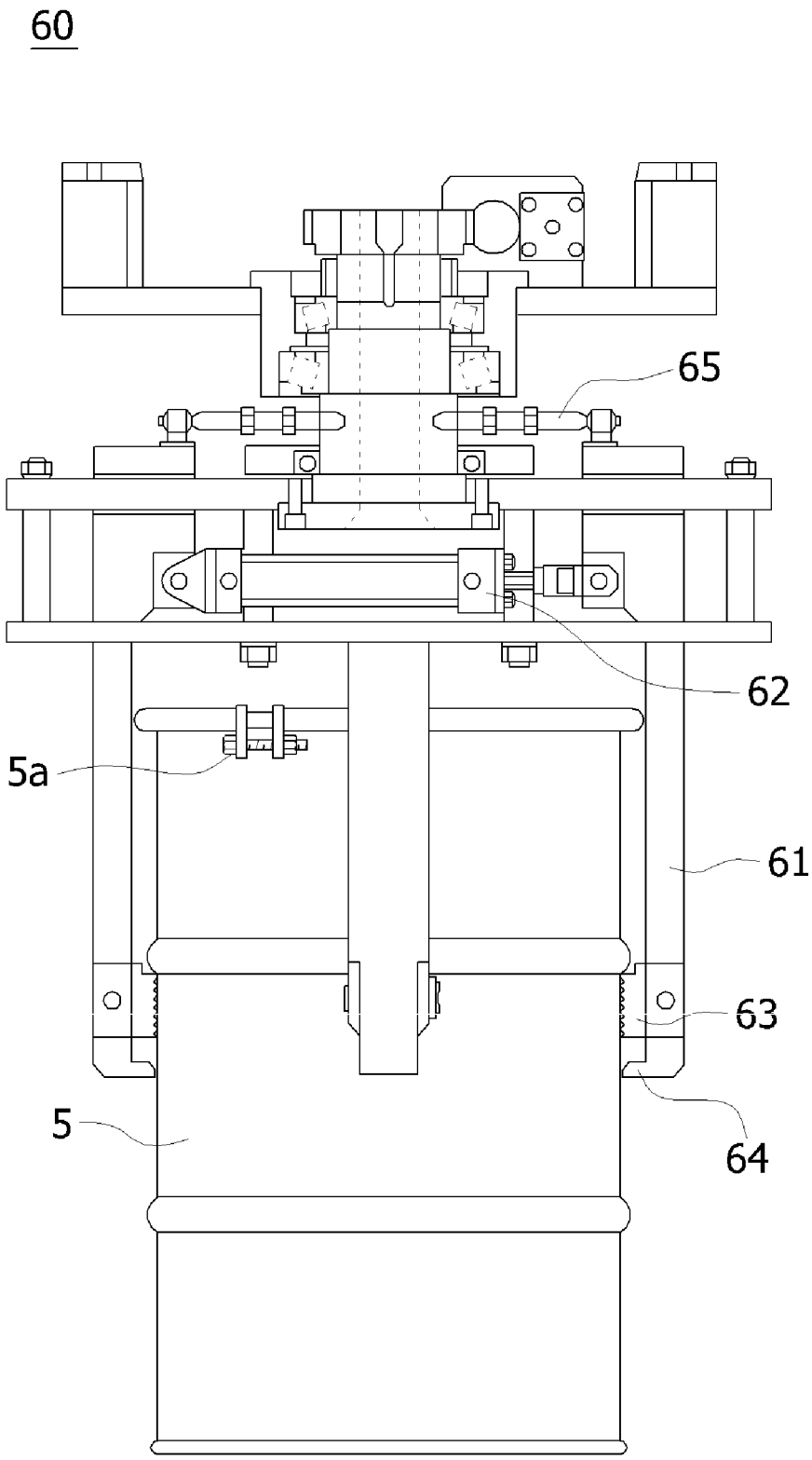
FIG. 4 illustrates construction of a gripper for gripping a drum and a drum container lid in an apparatus for automatically loading drums into a drum container according to an exemplary embodiment of the present invention.

FIG. 4 illustrates construction of a gripper for gripping a drum and a drum container lid in an apparatus for automatically loading drums into a drum container according to an exemplary embodiment of the present invention.

The gripper 60 is characterized by a structure in which the drum 5 and the drum container lid 22 can be compatibly transferred when the drum 5 is loaded into the drum container 20 from the drum feeder 10. In FIG. 4, the state where the gripper 60 grips the drum 5 is shown.

The gripper 60 includes a plurality of gripper arms 61 radially installed at regular angular intervals, an arm hydraulic unit 62 reciprocating the gripper arms 61 in a radial direction, jaws 63 installed on inner sides of the gripper arms 61 and gripping an outer surface of the drum 5, and latches 64 protruding from the inner sides of the gripper arms 61 and latched on the drum container lid 22.

The gripper 60 may further include an arm rotating mechanism 65, which rotates the gripper arms 61 to a position where it is easy to grip the drum 5.

The jaws 63 may be installed on inner sides of lower portions of the gripper arms 61 in consideration of the gripping position of the drum 5. The latches 64 may be installed on inner sides of lower ends of the gripper arms 61 in consideration of a latching position of the drum container lid 22.

Now, a method of loading the drums 5 into the drum container 20 using the drum feeder 10 and the drum container clamp 30 will be described step by step.

To load the drums 5, which are transferred by the drum feeder 10, into the drum container 20, the drum container 20 must be fixed using the drum container clamp 30, and the lid 22 of the drum container 20 must be separated from the body 21 of the drum container 20, and then be transferred to the support frame 40.

First, when the drum container 20 is placed on the drum container pedestals 33, the oil supply 32 of the drum container clamp 30 applies an oil pressure to the hydraulic cylinder 31, and thus the hydraulic cylinder 31 is operated to push the drum container 20 toward the drum container pedestals 33-1 located on the side opposite the hydraulic cylinder 31.

When the drum container 20 is pushed toward and closely contacted with the brackets 33*b* of the drum container pedestals 33-1 on the side opposite the hydraulic cylinder 31 by the operation of the hydraulic cylinder 31, bolts connecting the body 21 and lid 22 of the drum container 20 are unfastened, and then the drum container lid 22 is gripped by the gripper 60, and is transferred to the support frame 40.

Then, the drum 5 is transferred to the turntable 15 through the drum feeder 10, and then the drums 5, each of which is placed on the turntable 15, are sequentially loaded into the drum container 20 using the gripper 60.

When the drum 5 is transferred to the turntable 15 through the conveyor modules 12 of the drum feeder 10, and then the turntable 15 on which the drum 5 is placed is rotated such that the drum 5 placed on the turntable 15 is directed to a direction where the gripper 60 can grip the drum 5.

Here, the controller controls a rotational amount of the turntable 15 on the basis of a position signal of the drum bolt 5*a* sensed by the sensors 16 such that the drum bolt 5*a* is located at a position where it does not interfere with the gripper arms 61 of the gripper 60 when the drum 5 is gripped by the gripper 60.

When the drum 5 placed on the turntable 15 is located at a designated position, the gripper 60 grips the drum 5, and the lifter 55 raises the gripper 60 gripping the drum 5, and moves in forward and backward, or left and right directions by the crane 50, and lowers the gripper 60 above a designated position within the drum container 20. Thereby, the drum 5 is automatically loaded.

When this process is repeated, and thus the drums 5 are completely loaded into the drum container 20, the gripper 60 moves to the support frame 40, grips the drum container lid 22, transfers the drum container lid 22 above the drum container body 21, and lowers the drum container lid 22.

In this case, when a position control system is applied, the drum container lid 22 is placed on the drum container body 21 in the same state when it is separated from the drum container body 21.

According to an exemplary embodiment of the present invention, the drum loading apparatus is configured to employ the drum feeder and the drum container clamp, and to connect the lifter with the gripper via the cylinders and the rods such that the drum is prevented from swinging while being transferred, so that the process of loading the drums can be automated to enhance accuracy of the loading position.

Further, the collisions between the drum and the drum container and between the drums are prevented when the drums are loaded, so that it is possible to prevent damage of the drum, maximize the efficiency of operation when a large quantity of drums are loaded, enhance safety when a heavy object is handled, and reduce necessary manpower and time.

In addition, since the lid is covered on the drum container after the drums are completely loaded, no separate process or apparatus for positioning a position of the lid is required, so that it is possible to minimize the radiation exposure risk of a worker.

What is claimed is:

1. An apparatus for automatically loading drums, comprising:

a drum feeder including a plurality of conveyor modules transferring drums, and a turntable rotating a drum transferred by the conveyor modules to an orientation in which the drum can be gripped;

a drum container into which drums transferred through the drum feeder are sequentially loaded;

a support frame on which a lid of the drum container is placed when drums are being loaded into the drum container; and a crane including a gripper that grips and transfers a drum or the drum container lid, and a lifter on which the gripper is mounted for upward and downward movement and which is transferred along guide rails in forward and backward, or left and right, directions.

2. The apparatus as set forth in claim 1, wherein the drum feeder further includes:

sensors sensing position of a drum bolt fastened on an outer circumference of a drum and generating position signals indicative of the position of a drum bolt sensed; and a controller controlling rotation of the turntable based on the position signals generated by the sensors.

3. The apparatus as set forth in claim 1, wherein each conveyor module includes an interlocking unit that restricts movement of a downstream conveyor module when a drum is located on an upstream conveyor module.

4. The apparatus as set forth in claim 1, wherein the gripper includes:

a plurality of gripper arms radially arranged at a uniform angular interval;

an arm hydraulic unit reciprocating the gripper arms in a radial direction;

jaws installed on inner sides of the gripper arms and gripping an outer surface of a drum in response to operation of the arm hydraulic unit; and latches protruding from the inner sides of the gripper arms and latching the drum container lid.

5. The apparatus as set forth in claim 1, wherein the lifter includes a plurality of cylinders and rods for transferring the gripper in upward and downward directions to prevent the gripper, when gripping a drum or the drum container lid, from swinging.

6. An apparatus for automatically loading drums, comprising:

a drum feeder for transferring drums;

a drum container into which drums transferred through the drum feeder are sequentially loaded;

a support frame on which a lid of the drum container is placed when the drums are being loaded into the drum container;

a crane including a gripper that grips and transfers a drum or the drum container lid, and a lifter on which the gripper is mounted for upward and downward movement and which is transferred along guide rails in forward and backward, or left and right, directions; and a drum container clamp including drum container pedestals on which corners of the drum container are supported, and a pusher that pushes the drum container, supported on the drum container pedestals, on a first side of the drum container and fixes the drum container in contact with the drum container pedestals on a second side of the drum container.

7. The apparatus as set forth in claim 6, wherein each drum container pedestal includes:

a base plate; and a bracket having a shape corresponding to shape of each corner of the drum container and which protrudes upward from the base plate.

8. The apparatus as set forth in claim 7, wherein the brackets are disposed at a longer distance than length of the drum container in a direction along which the drum container is pushed by the pusher, and at a distance corresponding to width of the drum container in a direction perpendicular to the direction along which the drum container is pushed by the pusher.

9. The apparatus as set forth in claim 6, wherein the pusher includes a hydraulic cylinder and an oil supply.

10. The apparatus as set forth in claim 6, wherein the gripper includes:

a plurality of gripper arms radially arranged at a uniform angular interval;

an arm hydraulic unit reciprocating the gripper arms in a radial direction;

jaws installed on inner sides of the gripper arms and gripping an outer surface of a drum by operation of the arm hydraulic unit; and latches protruding from the inner sides of the gripper arms and latching the drum container lid.

11. The apparatus as set forth in claim 6, wherein the lifter includes a plurality of cylinders and rods for transferring the gripper in upward and downward directions to prevent the gripper, when gripping a drum or the drum container lid, from swinging.

12. A method of automatically loading drums into a drum container, the method comprising:

placing the drum container on pedestals for the drum container into which the drums are loaded;

pushing a first side of the drum container placed on the drum container pedestals using a pusher and fixing the drum container in contact with the drum container pedestals located on a second side of the drum container;

separating a lid of the drum container from a body of the drum container using a gripper;

transferring drums to a turntable using a plurality of conveyor modules;

rotating the turntable to position a drum placed on the turntable to face a direction where the drum can be gripped by the gripper;

sequentially loading drums into the drum container using the gripper; and placing the drum container lid on the drum container body using the gripper when the loading of the drums has been completed.

13. The method as set forth in claim 12, wherein the rotating of the turntable to position a drum placed on the turntable to face a direction where the drum can be gripped by the gripper includes:

sensing position of a drum bolt fastened on an outer circumference of the drum; and controlling rotational of the turntable based on position of the drum bolt sensed by the sensors.

* * * * *